US008019240B2

(12) United States Patent
Kakuta et al.

(10) Patent No.: US 8,019,240 B2
(45) Date of Patent: Sep. 13, 2011

(54) DEVELOPING APPARATUS, PROCESS CARTRIDGE, AND ELECTROPHOTOGRAPHIC IMAGE FORMING APPARATUS

(75) Inventors: Hideki Kakuta, Suntou-gun (JP); Tatsuya Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 12/274,805

(22) Filed: Nov. 20, 2008

(65) Prior Publication Data

US 2009/0297175 A1 Dec. 3, 2009

(30) Foreign Application Priority Data

May 27, 2008 (JP) ..... 2008-138042

(51) Int. Cl.
*G03G 15/08* (2006.01)

(52) U.S. Cl. ..... 399/27

(58) Field of Classification Search ..... 399/61, 399/74, 29, 30, 27
See application file for complete search history.

(56) References Cited

U.S. PATENT DOCUMENTS

| | | | | |
|---|---|---|---|---|
| 5,436,704 | A * | 7/1995 | Moon | 399/30 |
| 5,557,368 | A * | 9/1996 | Endo et al. | 399/27 |
| 6,016,408 | A * | 1/2000 | Hashimoto et al. | 399/27 |
| 6,101,342 | A * | 8/2000 | Eom et al. | 399/29 |
| 6,256,459 | B1 | 7/2001 | Hasegawa et al. | |
| 6,654,575 | B2 | 11/2003 | Miura et al. | |
| 2001/0051051 | A1 * | 12/2001 | Matsumoto | 399/30 |
| 2004/0247331 | A1 * | 12/2004 | Minagawa et al. | 399/27 |
| 2006/0251445 | A1 | 11/2006 | Ueno et al. | |
| 2007/0036565 | A1 * | 2/2007 | Okino et al. | 399/27 |
| 2008/0187357 | A1 | 8/2008 | Miura et al. | |

FOREIGN PATENT DOCUMENTS

| | | | |
|---|---|---|---|
| JP | 2001-312133 | A | 9/2001 |
| JP | 2002-162821 | A | 6/2002 |
| JP | 2003-131479 | A | 5/2003 |
| JP | 2003-167490 | A | 6/2003 |
| JP | 2004-126003 | A | 4/2004 |
| JP | 2004354524 | A * | 12/2004 |
| JP | 2006-79025 | A | 3/2006 |
| JP | 2006-208552 | A | 8/2006 |
| JP | 2006-251145 | A | 9/2006 |
| JP | 2006-343722 | A | 12/2006 |

OTHER PUBLICATIONS

Notification of the First Office Action dated Nov. 15, 2010, in counterpart Chinese Application No. 200810179727.5.

* cited by examiner

*Primary Examiner* — Susan S Lee
(74) *Attorney, Agent, or Firm* — Fitzpatrick, Cella, Harper & Scinto

(57) ABSTRACT

A developing apparatus used in an electrophotographic image forming apparatus includes: a developing roller for developing a latent image formed on a photosensitive drum; a developing container for containing developer; a developer conveying member for supplying the developer from the developing container to the developing roller; a light transmissive member provided in the developing container, and formed integrally with a light emitting guide portion for guiding, into the developing container, a detecting light from a light emitting element provided in an electrophotographic image forming apparatus main body to detect a developer remaining amount in the developing container and a light receiving guide portion for guiding the detecting light that has passed through the developing container to a light receiving element provided in the apparatus main body; and a regulating member for covering at least a space between the light emitting guide portion and the light receiving guide portion.

12 Claims, 9 Drawing Sheets

DEVELOPING APPARATUS, PROCESS CARTRIDGE, AND ELECTROPHOTOGRAPHIC IMAGE FORMING APPARATUS

BACKGROUND OF THE INVENTION

1. Field of the Invention

The present invention relates to an electrophotographic image forming apparatus, a developing apparatus used in the electrophotographic image forming apparatus, and a process cartridge detachably mounted to the electrophotographic image forming apparatus.

Here, the electrophotographic image forming apparatus refers to an apparatus for forming an image on a recording medium by an electrophotographic image forming method. Further, examples of the electrophotographic image forming apparatus include an electrophotographic copying machine, an electrophotographic printer (such as a laser beam printer and a light emitting diode (LED) printer), a facsimile apparatus, and a word processor.

Further, a developing apparatus refers to an apparatus for visualizing an electrostatic latent image formed on an image bearing member such as an electrophotographic photosensitive member with the use of a developer.

Further, a process cartridge refers to a cartridge into which charging means, developing means or cleaning means, and an image bearing are integrally incorporated, the cartridge being detachably mountable to a main body of an electrophotographic image forming apparatus. Moreover, a process cartridge refers to a cartridge into which at least charging means and an image bearing member are integrally incorporated, the cartridge being detachably mountable to a main body of an electrophotographic image forming apparatus.

2. Description of the Related Art

Conventionally, in an electrophotographic image forming apparatus employing an electrophotographic image formation process, an electrophotographic photosensitive member and process means which acts on the electrophotographic photosensitive member are integrally incorporated into a cartridge.

Then, a process cartridge system in which the cartridge is detachably mountable to a main body of an electrophotographic image forming apparatus is employed. The process cartridge system enables a user to do maintenance of an electrophotographic image forming apparatus without relying on a service person. Thus, the marked improvement in operability of the electrophotographic image forming apparatus can be obtained.

One of the primary conditions for process cartridge replacement is developer depletion (out of developer). In such a case, in order to prompt a user to timely replace process cartridges by giving the user the information regarding a developer remaining amount in advance, the developer remaining amount in a process cartridge has been detected by various methods in recent years.

One of the various methods is a light transmissive type developer remaining amount detection. In the light transmissive type developer remaining amount detection, a detecting light passing inside the process cartridge is detected based on a length of time during which a toner within a container blocks the detecting light. There are some process cartridges having a light emitting guide portion and a light receiving guide portion provided therein as means for guiding the detecting light into the process cartridge. The light emitting guide portion guides a detecting light emitted from a light emitting portion such as LED, which is attached to the electrophotographic image forming apparatus main body or the like, into the process cartridge. The light receiving guide portion guides the detecting light, which has been introduced into the process cartridge, to a light receiving portion such as a phototransistor attached to the electrophotographic image forming apparatus main body or the like. The light emitting guide portion and the light receiving guide portion are separately attached to the process cartridge (Japanese Patent Application Laid-Open No. 2003-131479).

If the light emitting guide portion and the light receiving guide portion are separately provided, the number of components and the number of the manufacturing steps for assembly are increased. Accordingly, there is proposed a process cartridge in which the light emitting guide portion and the light receiving guide portion are integrated (Japanese Patent Application Laid-Open No. 2003-167490).

For example, when a light transmissive member integrating the light emitting guide portion with the light receiving guide portion for detecting the developer remaining amount as described above is made of only a transparent material, the accuracy of the developer remaining amount detection may be reduced.

Specifically, there is a case where light which is emitted from a light emitting element provided in the apparatus main body enters from portions other than the light emitting guide portion, and hence an amount of the light is increased, or where a reflected light reflected from outer walls other than incident surfaces and exit surfaces of the guide portions is detected by a light receiving element provided in the apparatus main body.

In order to avoid the above-mentioned case, there are proposed countermeasures such as providing a hood on the light receiving element for the purpose of preventing an unnecessary reflected light from entering the light receiving element, replacing the light emitting element with a light source emitting a parallel light instead of a diffusion light, and covering portions other than the light emitting guide portion and the light receiving guide portion of the light transmissive member with a frame or the like forming a container. However, it is conceivable that component cost is increased in the case of using a parallel light, and that the size of the electrophotographic image forming apparatus becomes larger in the case of covering the portions with a hood or a container frame.

SUMMARY OF THE INVENTION

Accordingly, it is an object of the present invention to provide a developing apparatus, a process cartridge, and an electrophotographic image forming apparatus, which can excellently detect a developer remaining amount with a simpler structure capable of being downsized, in the case where a light transmissive member for detecting the developer remaining amount is integrated.

Further, it is another object of the present invention to provide a developing apparatus used in an electrophotographic image forming apparatus, the developing apparatus comprising: a developer carrying member for developing an electrostatic latent image faulted on an electrophotographic photosensitive member; a developing container for containing a developer to be supplied to the developer carrying member; a developer conveying member provided in the developing container, for supplying the developer within the developing container to the developer carrying member; a light transmissive member provided in the developing container, and formed integrally with a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a regulating member for covering the light transmissive member, the regulating member covering at least a space between the light emitting guide portion and the light receiving guide portion.

Further, it is another object of the present invention to provide a process cartridge detachably mountable to an electrophotographic image forming apparatus, the process cartridge comprising: an electrophotographic photosensitive member; a developer carrying member for developing an electrostatic latent image formed on the electrophotographic photosensitive member; a developing container for containing a developer to be supplied to the developer carrying member; a developer conveying member provided in the developing container, for supplying the developer within the developing container to the developer carrying member; a light transmissive member provided in the developing container, and formed integrally with a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a regulating member for covering the light transmissive member, the regulating member covering at least a space between the light emitting guide portion and the light receiving guide portion.

Further, it is another object of the present invention to provide an electrophotographic image forming apparatus for forming an image on a recording medium, the electrophotographic image forming apparatus comprising: (i) an electrophotographic photosensitive member; and (ii) a developing apparatus comprising: a developer carrying member for developing an electrostatic latent image formed on the electrophotographic photosensitive member; a developing container for containing a developer to be supplied to the developer carrying member; a developer conveying member provided in the developing container, for supplying the developer within the developing container to the developer carrying member; a light transmissive member provided in the developing container, and formed integrally with a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a regulating member for covering the light transmissive member, the regulating member covering at least a space between the light emitting guide portion and the light receiving guide portion.

Further, it is another object of the present invention to provide an electrophotographic image forming apparatus for forming an image on a recording medium, the electrophotographic image forming apparatus comprising: (i) a process cartridge comprising: an electrophotographic photosensitive member; a developer carrying member for developing an electrostatic latent image formed on the electrophotographic photosensitive member; a developing container for containing a developer to be supplied to the developer carrying member; a developer conveying member provided in the developing container, for supplying the developer within the developing container to the developer carrying member; a light transmissive member provided in the developing container, and formed integrally with a light emitting guide portion and a light receiving guide portion, wherein the light emitting guide portion is adapted to guide, into the developing container, a detecting light which is emitted from a light emitting element provided to an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a regulating member for covering the light transmissive member, the regulating member covering at least a space between the light emitting guide portion and the light receiving guide portion; and (ii) mounting means to which the process cartridge is detachably mounted.

Further features of the present invention become apparent from the following description of the exemplary embodiments with reference to the accompanying drawings.

DESCRIPTION OF THE EMBODIMENTS

First Embodiment

Figure 2:
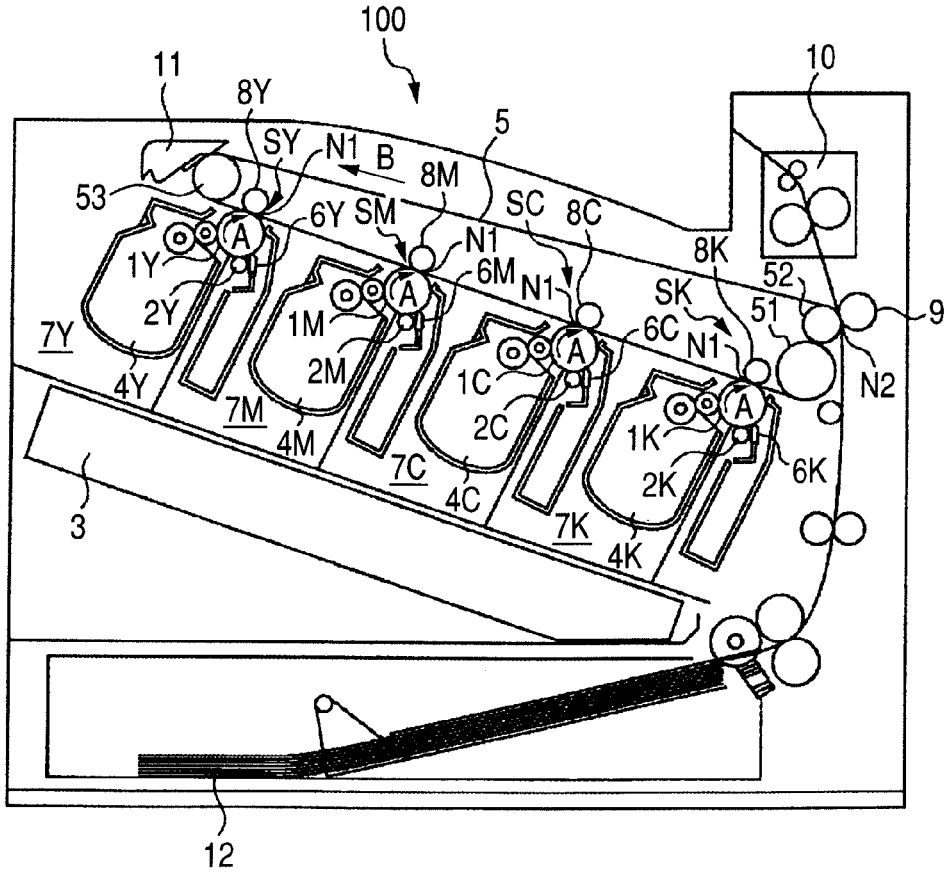
FIG. 2 is a sectional view of an electrophotographic image forming apparatus.

FIG. 2 illustrates a schematic structure of an electrophotographic image forming apparatus according to an embodiment of the present invention. In this embodiment, the electrophotographic image forming apparatus is a color electrophotographic image forming apparatus. However, the present invention is not limited to the color electrophotographic image forming apparatus, and is also applicable to a monochromatic electrophotographic image forming apparatus and further, to various electrophotographic image forming apparatuses.

First, the overall structure of the color electrophotographic image forming apparatus according to this embodiment is described.

(Overall Structure of Color Electrophotographic Image Forming Apparatus)

FIG. 2 is a schematic sectional view of an electrophotographic image forming apparatus 100 according to this embodiment. The electrophotographic image forming apparatus 100 according to this embodiment is a full-color laser beam printer employing an in-line system and an intermediate transfer system. The electrophotographic image forming apparatus 100 can form a full-color image on a recording material (for example, recording paper, plastic sheet, cloth, etc.) based on image information. The image information is input, to an electrophotographic image forming apparatus main body, from an image reading apparatus connected to the electrophotographic image forming apparatus main body or a host device such as a personal computer connected to the electrophotographic image forming apparatus main body so as to be communicable with each other.

The electrophotographic image forming apparatus 100 includes, as multiple image forming portions, a first image forming portion SY for forming an image having a color of yellow (Y), a second image forming portion SM for forming an image having a color of magenta (M), a third image forming portion SC for forming an image having a color of cyan (C), and a fourth image forming portion SK for forming an image having a color of black (K). In this embodiment, the first image forming portion SY, the second image forming portion SM, the third image forming portion SC, and the fourth image forming portion SK are arranged in a line in a direction intersecting a vertical direction.

Note that, in this embodiment, the structures and operations of the first image forming portion SY, the second image forming portion SM, the third image forming portion SC, and the fourth image forming portion SK are substantially the same except that a color of an image to be formed is different for each image forming portion. Accordingly, hereinafter, in the case where the first image forming portion SY, the second image forming portion SM, the third image forming portion SC, and the fourth image forming portion SK are specially not required to be distinguished from each other, suffixes Y, M, C, and K, which are additionally given to reference symbols so as to indicate which element is provided with which color, are omitted and collectively described.

In other words, in this embodiment, the electrophotographic image forming apparatus 100 includes, as a plurality of image bearing members, four drum-shaped electrophotographic photosensitive members, that is, photosensitive drums 1, which are arranged parallel to each other in the direction intersecting the vertical direction. Each of the photosensitive drums 1 is rotationally driven by a driving means (driving source) (not shown) in a direction indicated by the arrow A of FIG. 2 (in a clockwise direction). Around each of the photosensitive drums 1, there are arranged a charging roller 2 serving as a charging means for uniformly charging a surface of each of the photosensitive drums 1, and a scanner unit (exposure device) 3 serving as an exposure means for forming an electrostatic image (electrostatic latent image) on each of the photosensitive drums 1 by irradiation of a laser based on the image information. In addition, around each of the photosensitive drums 1, there are arranged a developing apparatus (hereinafter, referred to as developing unit) 4 serving as a developing means for developing the electrostatic image into a toner image, and a cleaning member 6 serving as a cleaning means for removing a developer (hereinafter, referred to as toner) remaining on the surface of each of the photosensitive drums 1 after transferring. Further, an intermediate transfer belt 5 serving as an intermediate transfer member for transferring the toner images formed on the photosensitive drums 1 to a recording material 12 is arranged opposite to the four photosensitive drums 1. In a rotation direction of the photosensitive drums 1, charging positions of the charging rollers 2, exposure positions of the scanner unit 3, developing positions of the developing units 4, transferring positions of the toner images to the intermediate transfer belt 5, and cleaning positions of the cleaning members 6 are defined in the stated order.

Note that, in this embodiment, each of the developing units 4 uses, as a developer, a non-magnetic mono-component developer, that is, a toner. Further, in this embodiment, the developing unit 4 brings the developing roller serving as a developer carrying member into contact with the photosensitive drum 1 to perform reversal development. Specifically, in this embodiment, the developing unit 4 makes the toner charged in the same polarity (negative polarity, in this embodiment) as a charging polarity of the photosensitive drum 1 adhered to a portion (image portion, exposure portion) having charges decaying due to the exposure performed on the photosensitive drum 1, thereby developing the electrostatic image.

In this embodiment, the photosensitive drum 1, and the charging roller 2, the developing unit 4, and the cleaning member 6, which serve as process means acting on the photosensitive drum 1 are integrally incorporated into a cartridge to form a process cartridge 7. The process cartridge 7 can be detachably mounted to the electrophotographic image forming apparatus 100 through mounting means such as a mounting guide and a positioning member which are provided in the main body of the electrophotographic image forming apparatus 100. In this embodiment, the process cartridges 7 for each color have the same shape, and each contain toners having the respective colors of yellow (Y), magenta (M), cyan (C), and black (K).

The intermediate transfer belt 5 serving as the intermediate transfer member, which is formed of an endless belt, abuts on all of the photosensitive drums 1, and moves while circulating (rotating) in a direction indicated by the arrow B (in a counterclockwise direction) of FIG. 2. The intermediate transfer belt 5 is passed over multiple supporting members, that is, a driving roller 51, a secondary transfer opposed roller 52, and a driven roller 53.

On an inner peripheral surface side of the intermediate transfer belt 5, there are arranged in parallel to each other four primary transfer rollers 8 serving as primary transfer means so as to be opposite to the respective photosensitive drums 1. Each of the primary transfer rollers 8 presses the intermediate transfer belt 5 toward each of the photosensitive drums 1, whereby a nip (primary transfer nip) is formed in a primary transfer portion N1 in which the intermediate transfer belt 5 and each of the photosensitive drums 1 are brought into contact with each other. Then, to each of the primary transfer rollers 8, a bias having an opposite polarity to a normal charging polarity of the toner is applied from a primary transfer bias source (high voltage power supply) serving as a primary transfer bias application means (not shown). With this application of the bias, the toner image formed on each of the photosensitive drums 1 is transferred (primarily transferred) on the intermediate transfer belt 5.

Further, on an outer peripheral surface side of the intermediate transfer belt 5, there is arranged a secondary transfer roller 9 serving as a secondary transfer means on a position opposite to the secondary transfer opposed roller 52. The secondary transfer roller 9 is brought into pressure contact with the secondary transfer opposed roller 52 through the intermediate transfer belt 5, whereby a nip (secondary transfer nip) is formed in a secondary transfer portion N2 in which the intermediate transfer belt 5 and the secondary transfer roller 9 are brought into contact with each other. Then, a bias having an opposite polarity to a normal charging polarity of the toner is applied from a secondary transfer bias source (high voltage power supply) serving as a secondary transfer bias application means (not shown) to the secondary transfer roller 9. With this application of the bias, the toner image formed on the intermediate transfer belt 5 is transferred (secondarily transferred) on the recording material 12. The primary transfer rollers 8 and the secondary transfer roller 9 are the same structure with each other.

At a time of image formation, first, a surface of the photosensitive drum 1 is uniformly charged by the charging roller 2. Then, the charged surface of the photosensitive drum 1 is scanned and exposed with a laser beam emitted from the scanner unit 3 according to the image information, whereby an electrostatic image according to the image information is formed on the photosensitive drum 1. Subsequently, the electrostatic image formed on the photosensitive drum 1 is developed into a toner image by the developing unit 4. The toner image formed on the photosensitive drum 1 is transferred (primarily transferred) onto the intermediate transfer belt 5 by actions of the primary transfer rollers 8.

For example, at a time of a full-color image formation, the above-mentioned process is sequentially performed in the first image forming portion SY, the second image forming portion SM, the third image forming portion SC, and the fourth image forming portion SK. Then, toner images of the respective colors are overlapped with each other on the intermediate transfer belt 5, thereby being primarily transferred.

After that, the recording material 12 is conveyed to the secondary transfer portion N2 in synchronization with the movement of the intermediate transfer belt 5, and four color toner images formed on the intermediate transfer belt 5 are secondarily transferred on the recording material 12 in a collective manner by an action of the secondary transfer roller 9 abutting on the intermediate transfer belt 5 through the recording material 12.

The recording material 12 having the toner image transferred thereon is conveyed to a fixing device 10 serving as a fixing means. In the fixing device 10, the toner image is fixed on the recording material 12 by applying heat and pressure to the recording material 12.

Further, a primary transfer residual toner remaining on the photosensitive drums 1 after the primary transfer process is removed by the cleaning members 6 to be collected in a removed toner chamber. A secondary transfer residual toner remaining on the intermediate transfer belt 5 after the secondary transfer process is removed by an intermediate transfer belt cleaning device 11.

Note that, the electrophotographic image forming apparatus 100 can form a monochromatic or multi-color image by using only one or some (not all) of desired image forming portions.

(Process Cartridge)

Figure 3:
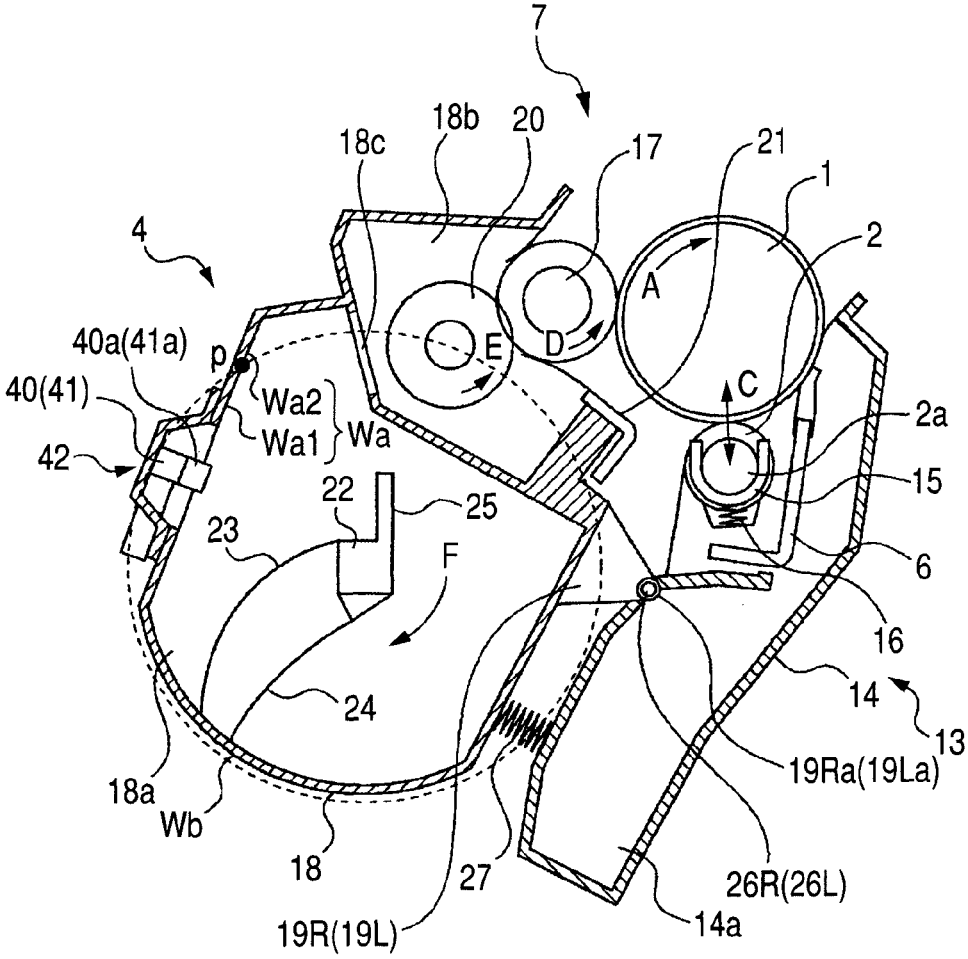
FIG. 3 is a sectional view of a process cartridge.

Next, the process cartridge 7 according to this embodiment is described in more detail with reference to FIG. 3. FIG. 3 is a main sectional view of the process cartridge 7 which is mounted to a main body of the electrophotographic image forming apparatus 100.

In this embodiment, a cartridge 7Y, which contains a yellow toner, a cartridge 7M, which contains a magenta toner, a cartridge 7C, which contains a cyan toner, and a cartridge 7K, which contains a black toner, are the same in structure.

The process cartridge 7 is divided into a photosensitive member unit 13 and the developing unit 4. Hereinafter, each of the units is described.

The photosensitive member unit 13 includes the photosensitive drum 1, the charging roller 2, and the cleaning member 6.

The photosensitive drum 1 is rotatably attached to a cleaning frame 14 of the photosensitive member unit 13 through a bearing (not shown). A driving force of a drive motor (not shown) is transmitted to the photosensitive member unit 13 to thereby rotationally drive the photosensitive drum 1 in a direction indicated by the arrow A in accordance with the image forming operations. On the periphery of the photosensitive drum 1, the charging roller 2 and the cleaning member 6 are arranged as described above. A residual toner removed from the surface of the photosensitive drum 1 by the cleaning member 6 falls into a removed toner chamber 14*a*.

A charging roller bearing 15 is attached to the cleaning frame 14 so as to be capable of moving in a direction indicated by the arrow C passing through the center of the charging roller 2 and the center of the photosensitive drum 1. A shaft 2*a* of the charging roller 2 is rotatably attached to the charging roller bearing 15, and the charging roller bearing 15 is pressurized by a charging roller pressurizing member 16 toward the photosensitive drum 1.

A developing container (hereinafter, referred to as a developing frame) 18 of the developing unit 4 is provided with a developer containing chamber (hereinafter, referred to as a toner chamber) 18*a* for containing the toner and a developing chamber 18*b* including a developing roller 17 serving as a developer carrying member which is brought into contact with the photosensitive drum 1 and rotated in a direction indicated by the arrow D.

In this embodiment, the developing chamber 18*b* is arranged on an upper portion of the toner chamber 18*a*, and the toner chamber 18*a* and the developing chamber 18*b* communicate with each other at an opening portion 18*c* located at an upper portion of the toner chamber 18*a*.

The developing roller 17 arranged in the developing chamber 18*b* is rotatably supported by the developing frame 18 through bearings (not shown) attached to both sides of the developing frame 18.

Besides, on the periphery of the developing roller 17, there are arranged a developer supplying member (hereinafter, referred to as toner supplying roller) 20 which is brought into contact with the developing roller 17 and rotated in a direction indicated by the arrow E, and a developing blade 21 for regulating a toner layer on the developing roller 17.

In the toner chamber 18*a* of the developing frame 18, a rotary shaft 22 is rotatably supported. Though described in more detail below, the rotary shaft 22 is provided with a developer conveying member (hereinafter, referred to as toner conveying member) 23 for agitating and conveying the toner contained in the toner chamber 18*a* to the toner supplying roller 20 and with a cleaning member 24 for cleaning a light transmissive window 40*a* of a light emitting guide portion 40 and a light transmissive window 41*a* of a light receiving guide portion 41.

Further, in the vicinity of the center in an outer wall longitudinal direction of a wall surface Wa which forms the toner chamber 18*a*, there is arranged a light transmissive member 42 which is formed integrally with the light emitting guide portion 40 and the light receiving guide portion 41 and can transmits light, the light transmissive member 42 serving as a toner detection member for performing a light transmissive type developer remaining amount detection (hereinafter, referred to as toner remaining amount detection). The shape of the light transmissive member 42 is described below.

The developing unit 4 is pivotally connected to the photosensitive member unit 13 about a shaft 26R (26L) fitted into a hole 19Ra (19La) provided in a bearing member 19R (19L). In the image formation by the process cartridge 7, the developing unit 4 is urged by a compression spring 27. Accordingly, the developing unit 4 is rotated about the shaft 26R (26L) and the developing roller 17 abuts on the photosensitive drum 1.

(Toner Conveying Method)

Next, a toner conveying structure according to this embodiment will be described. The toner chamber 18*a* has a bottom wall surface Wb and an inclined wall surface Wa along a rotation direction F of the toner conveying member 23 in a state where the process cartridge 7 is mounted to the main body of the electrophotographic image forming apparatus 100, that is, in a posture illustrated in FIG. 3. The inclined wall surface Wa includes a contact portion Wa1 which abuts on the toner conveying member 23 and a non-contact portion Wa2 which does not abut on the toner conveying member 23 on the downstream side of the contact portion Wa1 and the upstream side of the opening portion 18*c* in the rotation direction of the toner conveying member 23.

The toner conveying member 23 abuts on the bottom wall surface Wb and the contact portion Wa1 to be urged and deformed against an elastic force of the toner conveying member 23. Further, the toner conveying member 23 is rotated in contact with the bottom wall surface Wb and the contact portion Wa1, thereby conveying the toner in a state where the toner is carried on a surface of the toner conveying member 23 in the downstream side of the rotation direction thereof. When a distal end of a free end side of the toner conveying member 23 reaches the non-contact portion Wa2 along with the rotation of the toner conveying member 23, the abutment of the toner conveying member 23 on the inner wall of the toner chamber 18*a* is released. When the abutment of the toner conveying member 23 is released, the toner conveying member 23 is intended to change its shape into a natural state (original shape) by an elastic restoring force thereof. With the shape change of the toner conveying member 23 in the restoring direction, the toner carried on the toner conveying member 23 and conveyed is made to bounce toward the opening portion 18*c* located on the downstream side of the contact portion Wa1 and the non-contact portion Wa2 in the rotation direction of the toner conveying member 23 against gravity. In the present invention, a boundary point p between the contact portion Wa1 and the non-contact portion Wa2 is provided above the light transmissive windows 40*a* and 41*a*.

(Structure of Rotary Shaft)

Figure 4A:
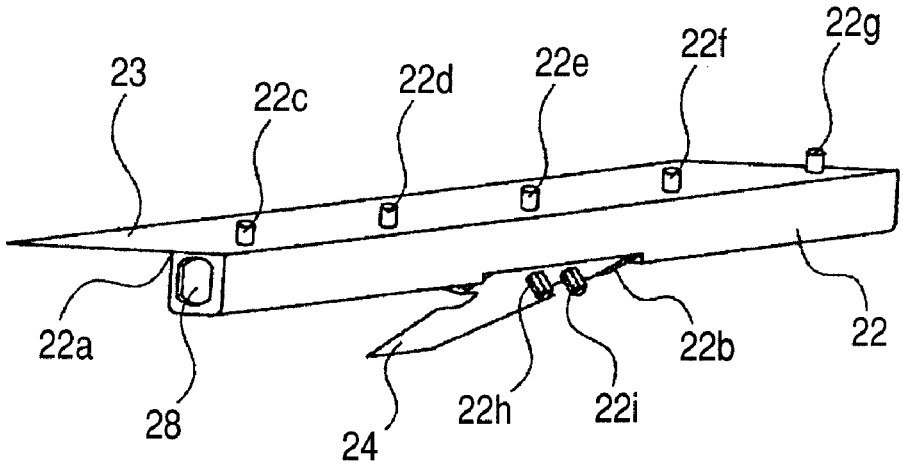
FIGS. 4A and 4B are schematic views of a rotary shaft.
Figure 4B:
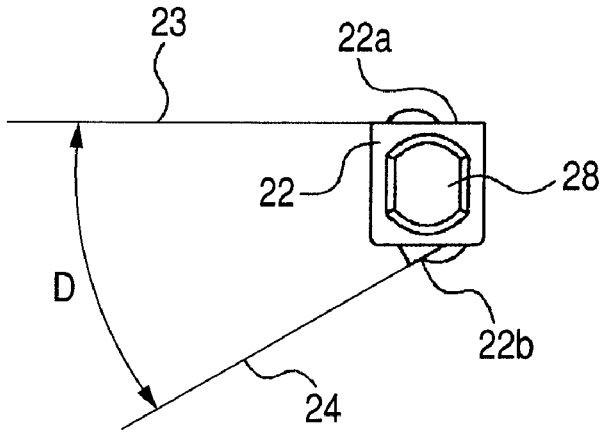

The rotary shaft 22 of the present invention will be described. FIGS. 4A and 4B are schematic views of the rotary shaft 22 of the present invention.

As illustrated in FIG. 4A, the toner conveying member 23 for conveying the toner is attached to one surface 22*a* forming the rotary shaft 22 over the substantially entire area of the rotary shaft 22 in a longitudinal direction of the rotary shaft 22. The toner conveying member 23 is a rectangular sheet member suitably manufactured by using a flexible sheet made of resin, such as a polyester film, a polyphenylene sulfide film, or a polycarbonate film with a thickness of, for example, 50 to 250 μm. The toner conveying member 23 is fixed to the rotary shaft 22 at its one end in a rotational radial direction by performing thermal caulking or ultrasonic welding on bosses 22*c* to 22*g* provided on the rotary shaft 22. The toner conveying member 23 is set to be longer by about 5 to 20 mm than a distance from the center of the rotary shaft to the contact portion Wa1 (see FIG. 3).

Figure 5A:
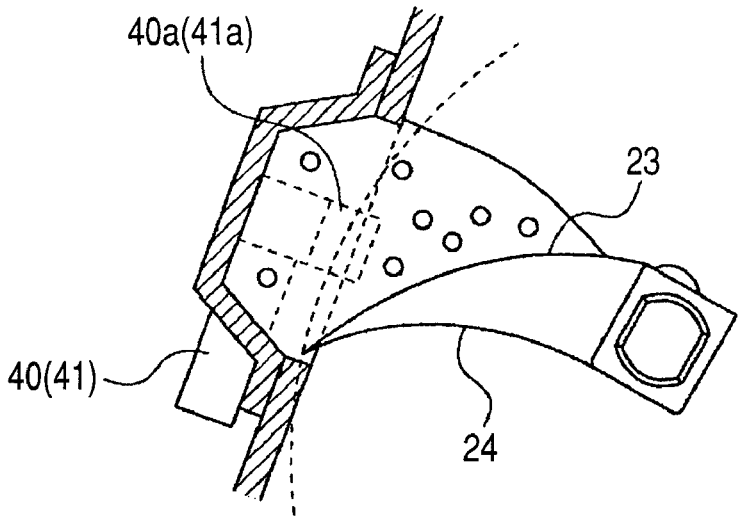
FIGS. 5A and 5B are explanatory views of a toner conveying member and a cleaning member depending on a toner amount.
Figure 5B:
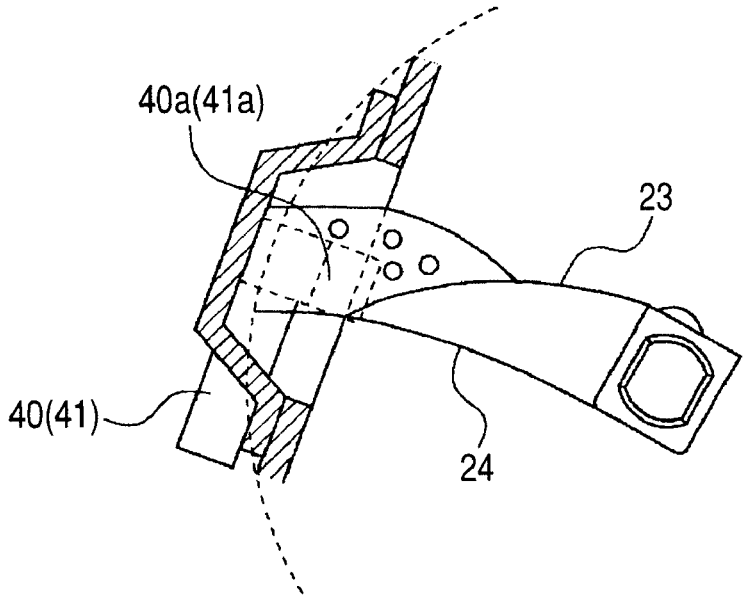

In the vicinity of the longitudinal center of the rotary shaft 22, the rotary shaft 22 is provided with a surface 22*b* located opposite to the attaching surface 22*a* for attaching the toner conveying member 23 in a phase of 30 degrees counterclockwisely with respect to the toner conveying member 23. Similarly to the toner conveying member 23, the cleaning member 24 is fixed on the surface 22*b* of the rotary shaft 22 at its one end in a rotational radial direction by performing thermal caulking or ultrasonic welding on bosses 22*h* and 22*i* provided on the rotary shaft 22. The reason why the cleaning member 24 is provided in a phase of 30 degrees with respect to the toner conveying member 23 is that the distal end of the free end side of the toner conveying member 23 is not made to contact the cleaning member 24 when the toner conveying member 23 abuts on the inner wall of the toner chamber 18*a* to be deformed. FIGS. 5A and 5B are explanatory views of a case where the toner conveying member 23 is brought into contact with the cleaning member 24. FIG. 5A illustrates a case of a larger amount of the toner conveyed by the toner conveying member 23, and FIG. 5B illustrates a case of a smaller amount of the toner conveyed by the toner conveying member 23. As illustrated in FIGS. 5A and 5B, when the toner conveying member 23 contacts the cleaning member 24, depending on the amount of the toner conveyed by the toner conveying member 23, the abutment state of the cleaning member 24 with respect to the light transmissive windows 40*a* and 41*a* is changed. In other words, when the amount of the toner conveyed by the toner conveying member 23 is larger, the cleaning member 24 is pressed down toward the upstream side of the rotation direction by the toner conveying member 23. If the abutment state of the cleaning member 24 with respect to the light transmissive windows 40*a* and 41*a* is changed, a state in which the toner adhered to the surfaces of the light transmissive windows 40*a* and 41*a* is removed is changed. This may cause variations in the accuracy of the light transmissive type toner remaining amount detection. In order to improve the accuracy of the light transmissive type toner remaining amount detection, the toner conveying member 23 and the cleaning member 24 are desirably not brought into contact with each other. Accordingly, as described above, in this embodiment, the cleaning member 24 is attached to the rotary shaft 22 with respect to the toner conveying member 23 substantially in the phase of 30 degrees. Note that, as described above, when the toner conveying member 23 is deformed, it is important to set the phase of the cleaning member 24 with respect to the toner conveying member 23 so that the distal end of the free end side of the toner conveying member 23 does not contact the cleaning member 24, and the angle of 30 degrees in phase is not a necessary condition.

Figure 6:
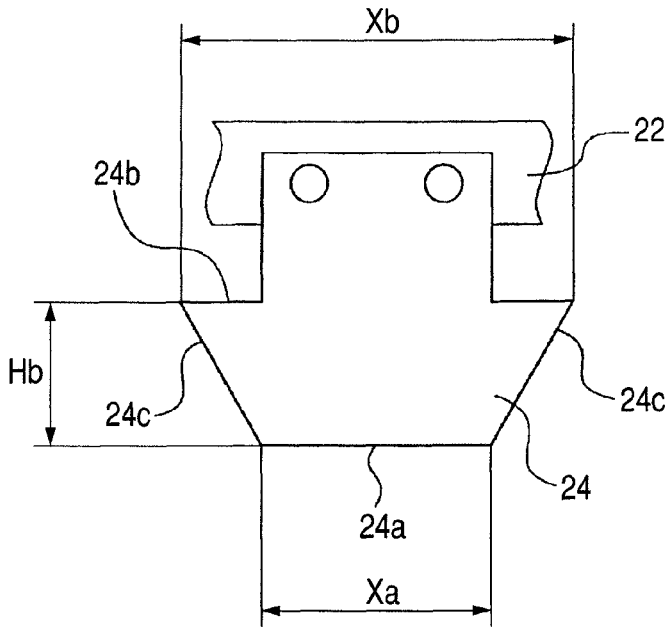
FIG. 6 is a schematic view of the cleaning member for toner.

FIG. 6 is a schematic view of the cleaning member 24. As illustrated in FIG. 6, the distal end of the free end side of the cleaning member 24 has a trapezoidal shape, in which an outer edge portion 24*a* of the cleaning member 24 in the rotational radial direction is made narrow (Xa) and an inner edge portion 24*b* which is inwardly (on the rotary shaft 22 side) spaced away by a height Hb is made wide (Xb) (Xa<Xb). Both of inclined side edge portions 24*c* of the cleaning member 24 formed into the trapezoidal shape contact the light transmissive windows 40*a* and 41*a* which are arranged in pairs, and wipe the light transmissive windows

40*a* and 41*a* to remove the toner adhered thereto. The cleaning member 24 can be suitably manufactured by using a flexible sheet made of resin, such as a polyester film or a polyphenylene sulfide film. The thickness of the sheet member is suitably set to 50 to 250 μm so that the cleaning member 24 can go through between the light transmissive windows 40*a* and 41*a* with ease.

Further, the transmission of the driving force to the rotary shaft 22 is performed by a driving gear (not shown), which penetrates a side surface wall of the toner chamber 18*a*, inserted into a fitting hole 28 provided in the rotary shaft 22 as illustrated in FIGS. 4A and 4B.

(Light Transmissive Member)

Figure 1A:
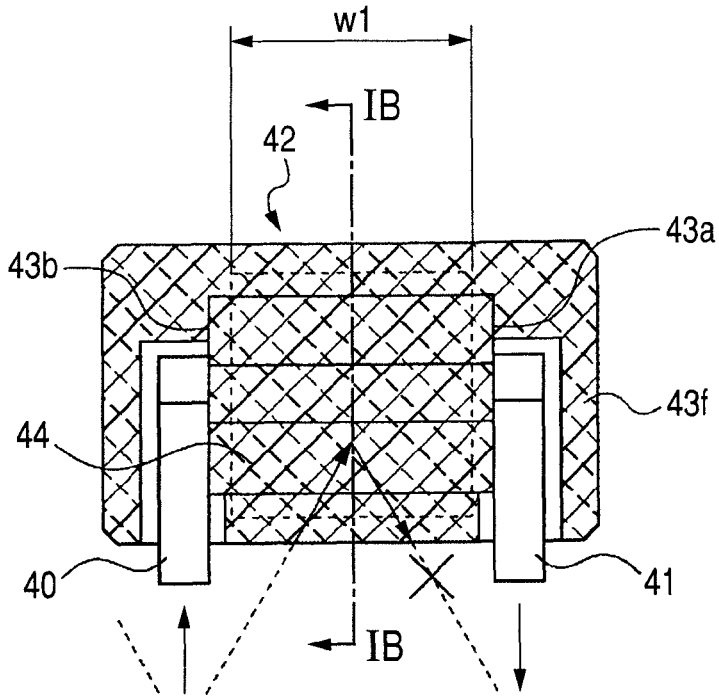
FIG. 1A is a schematic view of a light transmissive member according to a first embodiment of the present invention.
Figure 1B:
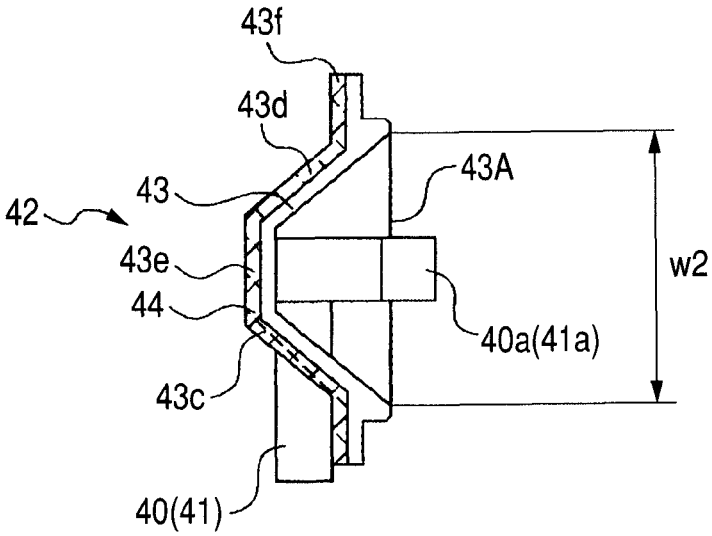
FIG. 1B is a sectional view taken along the line IB-IB of FIG. 1A.

FIGS. 1A and 1B are schematic views of the light transmissive member 42 according to this embodiment. In this embodiment, between the light emitting guide portion 40 and the light receiving guide portion 41, there is formed a detecting portion 43 having a convex shape outwardly in the rotational radius of the toner conveying member 23. As is apparent from FIGS. 1A and 1B, the detecting portion 43 is a box-shaped space which communicates with the toner chamber 18*a* and is provided with an opening 43A of a longitudinal length w1×a lateral length w2. In other words, the detecting portion 43 includes both of side walls 43*a*, 43*b*, which are arranged opposite to each other in the rotation axis direction of the toner conveying member 23, wall surfaces 43*c*, 43*d*, which are formed opposite to each other in the upstream side and the downstream side of the rotation direction of the toner conveying member 23, and a wall surface 43*e* opposite to the opening 43A.

Besides, the light transmissive member 42 according to this embodiment is formed by integrating the light emitting guide portion 40 and the light receiving guide portion 41, and the detecting portion 43. Compared with a separate structure of those components, the integrally formed light transmissive member 42 can be formed while reducing the number of components and the number of manufacturing steps for assembly. At the same time, the accuracy of a position of the light transmissive window 41*a* with respect to the light transmissive window 40*a* is easily ensured, and hence the decay of the detecting light due to component accuracy can be suppressed.

Figure 7:
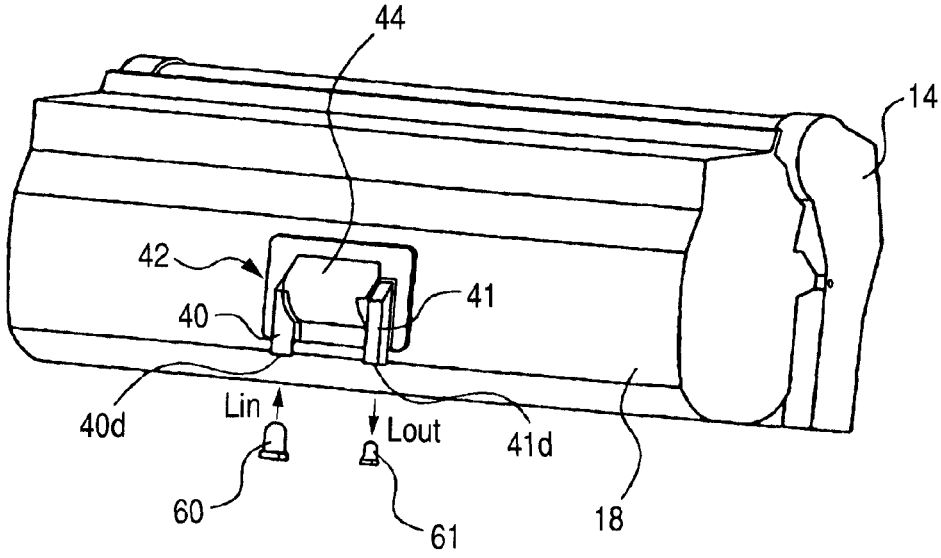
FIG. 7 is a schematic view of a light transmissive member and a regulating member.

FIG. 7 is an appearance perspective view of the process cartridge mounted to the electrophotographic image forming apparatus. As illustrated in FIG. 7, in the electrophotographic image forming apparatus in a state where the process cartridge is mounted thereto, a light emitting element 60 is arranged in a position opposite to an incident surface 40*d* of the light emitting guide portion 40, and a light receiving element 61 is arranged in a position opposite to an exit surface 41*d* of the light receiving guide portion 41.

Further, in this embodiment, there is provided a regulating member 44 for preventing a detecting light Lin emitted from the light emitting element 60 from entering into the light transmissive member 42 through portions other than the incident surface 40*d* and preventing a reflected light reflected from an outer wall (outer surface) other than the incident surface 40*d* and the exit surface 41*d* from being detected by the light receiving element 61. As illustrated in FIGS. 1A and 1B, the regulating member 44 is a black resin having a light shielding property and is formed so as to cover an outer wall including the wall surfaces 43*c*, 43*d*, 43*e* forming the detecting portion 43 and an attaching surface 43*f* through which the light transmissive member 42 is attached to the toner chamber 18*a*. The light transmissive member 42 and the regulating member 44 are integrally formed by coinjection molding.

(Light Transmissive Type Toner Remaining Amount Detection)

Figure 8A:
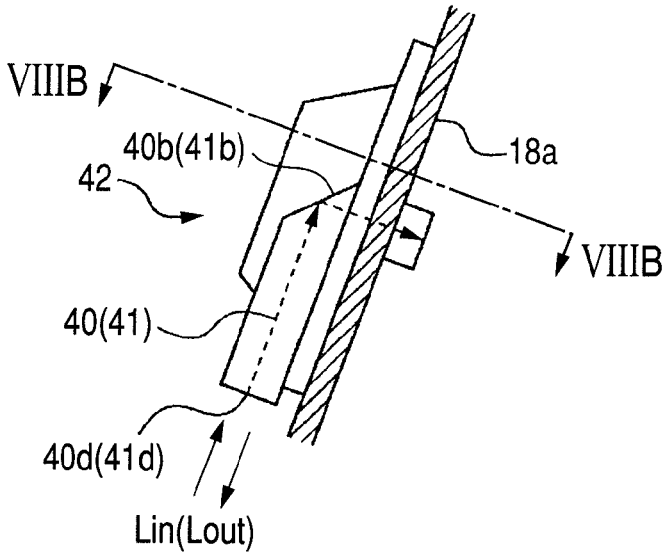
FIG. 8A is an explanatory view of an optical path for a toner remaining amount detection and FIG. 8B is a sectional view taken along the line VIIIB-VIIIB of FIG. 8A.
Figure 8B:
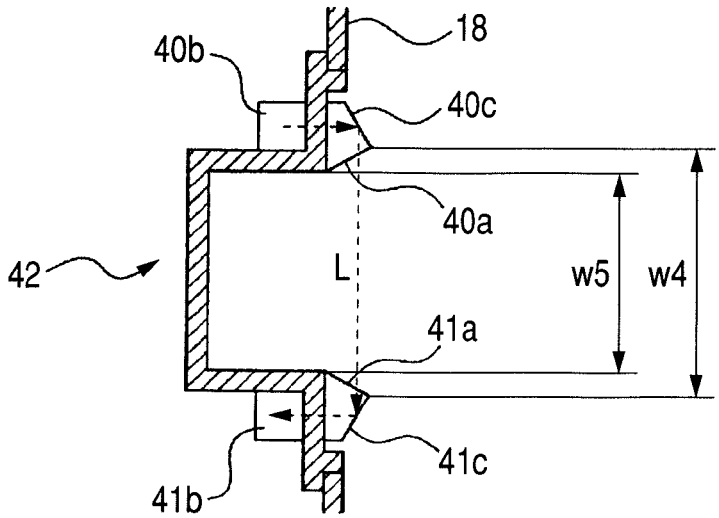

Next, the light transmissive type toner remaining amount detection in the present invention will be described. FIGS. 8A and 8B are schematic views illustrating an optical path in the present invention.

The light transmissive window 40*a* of the light emitting guide portion 40 and the light transmissive window 41*a* of the light receiving guide portion 41 each for performing the light transmissive type toner remaining amount detection are arranged opposite to each other along the rotation axis direction of the toner conveying member 23 as illustrated in FIG. 8B. As illustrated in FIG. 8A, the detecting light Lin emitted from the light emitting element (light emitting portion such as a light emitting diode (LED)) 60 attached to the main body of the electrophotographic image forming apparatus 100 is guided into the light emitting guide portion 40. The detecting light Lin is deflected by a reflecting surface 40*b* of the light emitting guide portion 40 to the toner chamber 18*a*. The deflected detecting light is, as illustrated in FIG. 8B, further deflected by a reflecting surface 40*c* so as to be directed to the light transmissive window 40*a* to be guided into the toner chamber 18*a*. The detecting light L output from the light transmissive window 40*a* of the light emitting guide portion 40 passes through the inside of the toner chamber 18*a* to be led to the light transmissive window 41*a* of the light receiving guide portion 41, which is arranged opposite to the light transmissive window 40*a*. After that, the detecting light L is deflected by reflecting surfaces 41*c* and 41*b* of the light receiving guide portion 41, and passes through the light receiving guide portion 41 to be output from the inside of the process cartridge to the outside of the process cartridge. A detecting light Lout output from the process cartridge is guided to the light receiving element (light receiving portion such as a phototransistor) 61 attached to the main body of the electrophotographic image forming apparatus 100. In this embodiment, as illustrated in FIG. 8B, the light transmissive windows 40*a* and 41*a* arranged opposite to each other are formed so that a distance w4 between the light transmissive windows 40*a* and 41*a* on a side adjacent to the toner chamber 18*a* is greater than a distance w5 between the light transmissive windows 40*a* and 41*a* on a side distant from the toner chamber 18*a* (that is, w4>w5).

Accordingly, as described above, in order to clean the inclined surfaces of the light transmissive windows 40*a* and 41*a* arranged opposite to each other, the cleaning member 24 is formed into the trapezoidal shape.

Figure 9A:
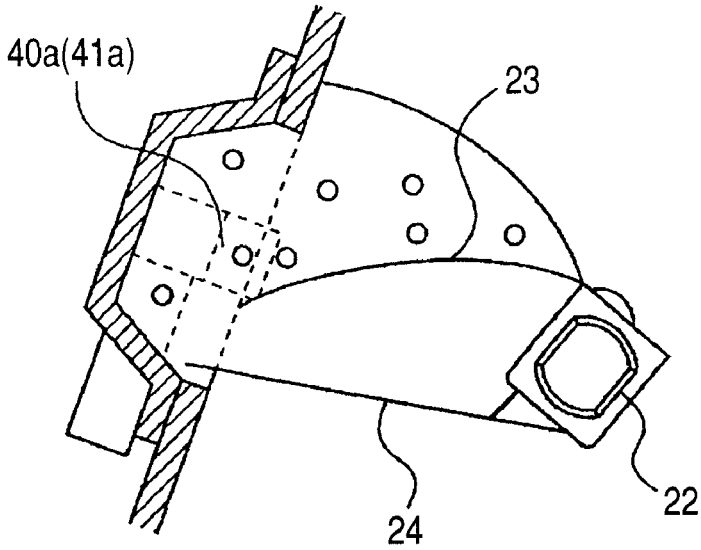
FIGS. 9A and 9B are explanatory views of the toner remaining amount detection.

FIG. 9A is a view illustrating a state immediately before the cleaning member 24 cleans the light transmissive windows 40*a* and 41*a*. The detecting light L is blocked by the toner conveyed by the toner conveying member 23 within the toner chamber 18*a*, and does not reach the light transmissive window 41*a* of the light receiving guide portion 41, whereby the light receiving portion in the main body of the electrophotographic image forming apparatus 100 does not detect the detecting light L.

Figure 9B:
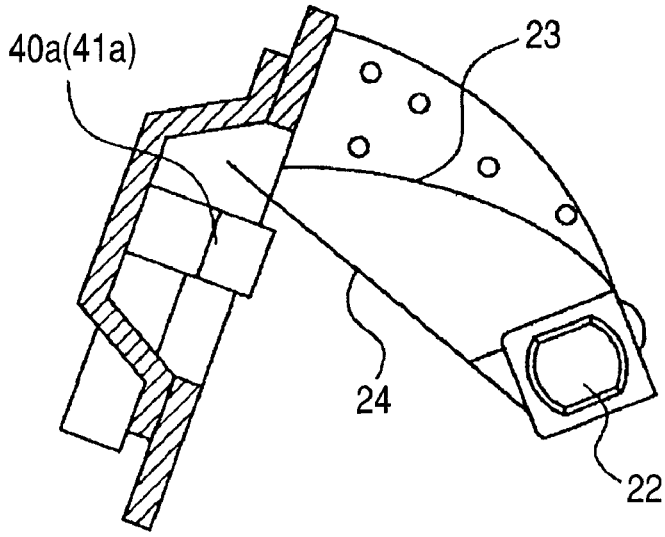

On the other hand, FIG. 9B is a view illustrating a state immediately after the cleaning member 24 cleans the light transmissive windows 40*a* and 41*a*. The detecting light L is transmitted to the inside of the toner chamber 18*a* and is detected by the light receiving portion in the main body of the electrophotographic image forming apparatus 100 through the light transmissive window 41*a* of the light receiving guide portion 41.

With the above-mentioned structure, a light receiving time of the detecting light L, during which the detecting light L is transmitted to the inside of the toner chamber 18*a* and is received in the light receiving portion of the electrophotographic image forming apparatus per one revolution of the toner conveying member 23, is determined, whereby the toner remaining amount within the toner chamber 18*a* is detected.

In this embodiment, the regulating member 44 is provided, and hence the detecting light emitted from the light emitting element 60 can be prevented from travelling toward the light receiving element 61 from paths other than the optical path for the toner remaining amount detection described above. Accordingly, even with the light transmissive member formed integrally with the light emitting guide portion and the light receiving guide portion, the accuracy of the remaining amount detection can be more enhanced.

Further, the light transmissive member 42 and the regulating member 44 are formed integrally with each other. In a case where the regulating member 44 is assumed to be formed of the developing frame, it is necessary to secure, between the regulating member 44 and the light transmissive member 42, a space required when the light transmissive member 42 is attached to the developing frame. On the other hand, in an integral molding, the space can be eliminated, whereby the electrophotographic image forming apparatus can be downsized.

Second Embodiment

Next, another further embodiment according to the present invention will be described. The basic structures of a developing apparatus, a process cartridge, and an electrophotographic image forming apparatus according to this embodiment are the same as those of the first embodiment of the present invention. Therefore, components having the same functions and structures as those of the first embodiment of the present invention or having the functions and structures corresponding thereto are denoted by the same reference symbols, and a detailed description thereof is omitted.

Figure 10:
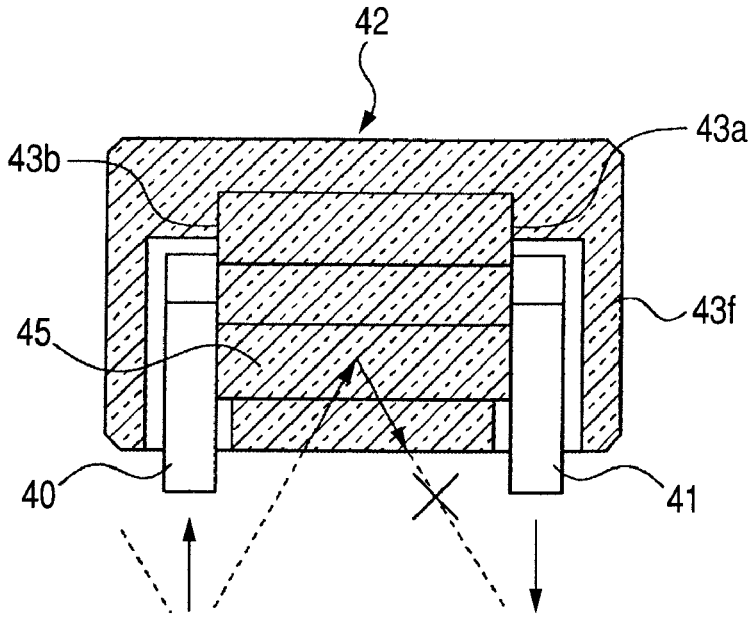
FIG. 10 is a schematic view of a light transmissive member according to a second embodiment of the present invention.

FIG. 10 is a schematic view of the light transmissive member according to this embodiment. In this embodiment as well, the light emitting guide portion 40 and the light receiving guide portion 41, and the detecting portion 43 are integrally formed as in the first embodiment of the present invention. A regulating member 45 in this embodiment is a paint such as a black ink, having the light shielding property, which is provided so as to cover the outer wall including the wall surfaces 43*c*, 43*d*, and 43*e* forming the detecting portion 43, and the attaching surface 43*f* through which the light transmissive member 42 is attached to the toner chamber 18*a*. With the regulating member 45, the detecting light emitted from the light emitting element 60 can be prevented from travelling toward the light receiving element 61 from paths other than the optical path for the toner remaining amount detection. Accordingly, the accuracy of the remaining amount detection is more enhanced as in the first embodiment of the present invention.

Third Embodiment

Next, another further embodiment according to the present invention will be described. The basic structures of a developing apparatus, a process cartridge, and an electrophotographic image forming apparatus according to this embodiment are the same as those of the first embodiment of the present invention. Therefore, components having the same functions and structures as those of the first embodiment of the present invention or having the functions and structures corresponding thereto are denoted by the same reference symbols, and a detailed description thereof is omitted.

Figure 11:
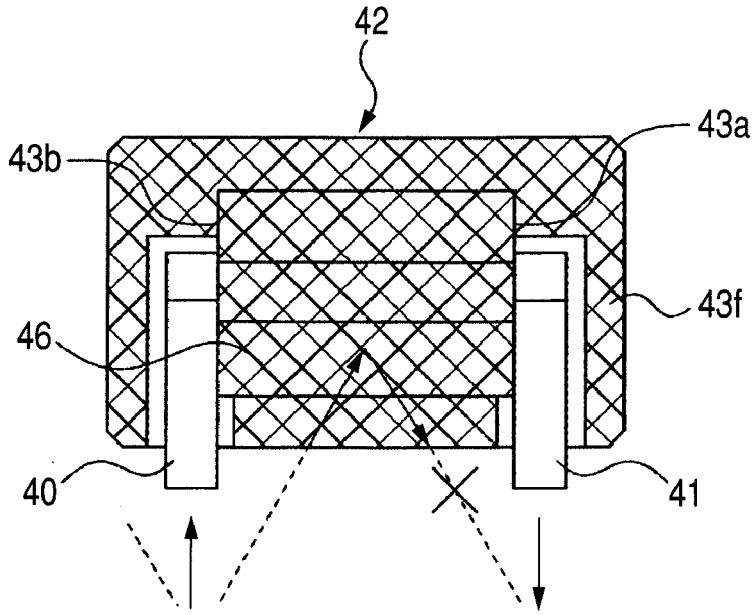
FIG. 11 is a schematic view of a light transmissive member according to a third embodiment of the present invention.

FIG. 11 is a schematic view of the light transmissive member according to this embodiment. In this embodiment as well, the light emitting guide portion 40 and the light receiving guide portion 41, and the detecting portion 43 are integrally formed as in the first embodiment of the present invention. A regulating member 46 in this embodiment is a black seal member having the light shielding property, which is provided so as to cover the outer wall including the wall surfaces 43*c*, 43*d*, and 43*e* forming the detecting portion 43, and the attaching surface 43*f* through which the light transmissive member 42 is attached to the toner chamber 18*a*. With the regulating member 46, the detecting light emitted from the light emitting element 60 can be prevented from travelling from paths other than the optical path for the toner remaining amount detection toward the light receiving element 61. Accordingly, the accuracy of the remaining amount detection is more enhanced as in the first embodiment of the present invention.

The present invention provides the regulating member so as to cover the outer wall of the light transmissive member between the light emitting guide portion and the light receiving guide portion. The regulating member can prevent the detecting light from entering through portions other than the light emitting guide portion, or prevent the reflected light reflected by the outer wall other than the incident and exit surfaces of the light emitting guide portion and the light receiving guide portion from being detected by the light receiving element provided in the electrophotographic image forming apparatus. Accordingly, even with the light transmissive member formed integrally with the light emitting guide portion and the light receiving guide portion, the accuracy of the remaining amount detection can be more enhanced.

Further, the integral formation of the transparent member and the regulating member allows the electrophotographic image forming apparatus to be downsized, compared to the structure in which an outer surface of a transparent portion of the light transmissive member is covered with a frame of the developing container or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-138042, filed May 27, 2008, which is hereby incorporated by reference herein in its entirety.

What is claimed is:

1. A developing apparatus used in an electrophotographic image forming apparatus, the developing apparatus comprising:

a developer carrying member for developing an electrostatic latent image formed on an electrophotographic photosensitive member;

a developing container for containing a developer to be supplied to the developer carrying member;

a developer conveying member provided in the developing container, for supplying the developer within the developing container to the developer carrying member;

a light transmissive member which has a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a covering member for covering an area between the light emitting guide portion and the light receiving guide portion in the light transmissive member, wherein the covering member reduces the detecting light which travels toward the light receiving elemnt, and wherein the covering member an the light transmissive member are formed integrally with each other by coinjection molding.

2. An electrophotographic image forming apparatus for forming an image on a recording medium, the electrophotographic image forming apparatus comprising:

(i) an electrophotographic photosensitive member; and (ii) a developing apparatus according to claim 1.

3. A developing apparatus used in an electrophotographic image forming apparatus, the developing apparatus comprising:

a developer carrying member for developing an electrostatic latent image formed on an electrophotographic photosensitive member;

a developing container for containing a developer to be supplied to the developer carrying member;

a developer conveying member provided in the developing container, for supplying the developer within the developing container to the developer carrying member;

a light transmissive member which has a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a covering member for covering an area between the light emitting guide portion and the light receiving guide portion in the light transmissive member, wherein the covering member comprises a paint reducing the detecting light which travels toward the light receiving element.

4. An electrophotographic image forming apparatus for forming an image on a recording medium, the electrophotographic image forming apparatus comprising:

(i) an electrophotographic photosensitive member; and (ii) a developing apparatus according to claim 3.

5. A developing apparatus used in an electrophotographic image forming apparatus, the developing apparatus comprising:

a developer carrying member for developing an electrostatic latent image formed on an electrophotographic photosensitive member;

a developing container for containing a developer to be supplied to the developer carrying member;

a developer conveying member provided in the developing container, for supplying the developer within the developing container to the developer carrying member;

a light transmissive member which has a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a covering member for covering an area between the light emitting guide portion and the light receiving guide portion in the light transmissive member, wherein the covering member comprises a seal reducing the detecting light which travels toward the light receiving element.

6. An electrophotographic image forming apparatus for forming an image on a recording medium, the electrophotographic image forming apparatus comprising:

(i) an electrophotographic photosensitive member; and (ii) a developing apparatus according to claim 5.

7. A developing apparatus used in an electrophotographic image forming apparatus, the developing apparatus comprising:

a developer carrying member for developing an electrostatic latent image formed on an electrophotographic photosensitive member;

a developing container for containing a developer to be supplied to the developer carrying member;

a developer conveying member provided in the developing container, for supplying the developer within the developing container to the developer carrying member;

a light transmissive member which has a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a covering member for covering an area between the light emitting guide portion and the light receiving guide portion in the light transmissive member, wherein the covering member reduces the detecting light which travels toward the light receiving element, and wherein the covering member and the light transmissive member are formed integrally with each other by coinjection molding.

8. An electrophotographic image forming apparatus for forming an image on a recording medium, the electrophotographic image forming apparatus comprising:

(i) a process cartridge according to claim 7; and (ii) mounting means to which the process cartridge is detachably mounted.

9. A process cartridge detachably mountable to an electrophotographic image forming apparatus, the process cartridge comprising:

an electrophotographic photosensitive member;

a developer carrying member for developing an electrostatic latent image formed on the electrophotographic photosensitive member;

a developing container for containing a developer to be supplied to the developer carrying member;

a developer conveying member provided in the developing container, for supplying the developer within the developing container to the developer carrying member;

a light transmissive member which has a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a covering member for covering an area between the light emitting guide portion and the light receiving guide portion in the light transmissive member, wherein the covering member comprises a paint reducing the detecting light which travels toward the light receiving element.

10. An electrophotographic image forming apparatus for forming an image on a recording medium, the electrophotographic image forming apparatus comprising:

(i) a process cartridge according to claim 9; and (ii) mounting means to which the process cartridge is detachably mounted.

11. A process cartridge detachably mountable to an electrophotographic image forming apparatus, the process cartridge comprising:

an electrophotographic photosensitive member;

a developer carrying member for developing an electrostatic latent image formed on the electrophotographic photosensitive member;

a developing container for containing a developer to be supplied to the developer carrying member;

a developer conveying member provided in the developing container, for supplying the developer within the developing container to the developer carrying member;

a light transmissive member which has a light emitting guide portion and a light receiving guide portion, wherein the light emitting guide portion is adapted to guide, into the developing container, a detecting light which is emitted from a light emitting element provided in an apparatus main body of the electrophotographic image forming apparatus and which is used for detecting a developer remaining amount in the developing container, and wherein the light receiving guide portion is adapted to guide the detecting light that has passed through the developing container to a light receiving element provided in the apparatus main body; and a covering member for covering an area between the light emitting guide portion and the light receiving guide portion in the light transmissive member, wherein the covering member comprises a seal reducing the detecting light which travels toward the light receiving element.

12. An electrophotographic image forming apparatus for forming an image on a recording medium, the electrophotographic image forming apparatus comprising:

(i) a process cartridge according to claim 11; and (ii) mounting means to which the process cartridge is detachably mounted.

* * * * *